United States Patent [19]

Marz

[11] Patent Number: 4,522,125

[45] Date of Patent: Jun. 11, 1985

[54] CHARGING LARGE DIAMETER VERTICAL BOREHOLES

[75] Inventor: Horst F. Marz, Otterburn Park, Canada

[73] Assignee: C-I-L Inc., North York, Canada

[21] Appl. No.: 607,647

[22] Filed: May 7, 1984

[30] Foreign Application Priority Data

Jun. 9, 1983 [CA] Canada ..... 430041

[51] Int. Cl.[3] ..... F42B 3/00

[52] U.S. Cl. ..... 102/313; 86/20 C; 102/312; 102/324; 166/63; 299/13

[58] Field of Search ..... 102/312, 313, 323, 324; 86/20 C; 175/3.5; 299/13; 166/63, 101, 212

[56] References Cited

U.S. PATENT DOCUMENTS 2,745,346 5/1956 Aitchison et al. ..... 86/20 C X
3,087,425 4/1963 Griffith, Jr. ..... 102/323
3,361,023 1/1968 Collins et al. ..... 86/20 C
3,949,673 4/1976 Lyerly ..... 102/324 X
3,986,430 10/1976 Coursen et al. ..... 102/313 X

*Primary Examiner*—Peter A. Nelson
*Attorney, Agent, or Firm*—Donald G. Ballantyne

[57] ABSTRACT

A method of charging upwardly extending, large diameter boreholes with cylindrical explosive cartridges is provided employing a longitudinally inflating flexible tube as the pushing mechanism. A fluid-impervious flexible tube is turned over or everted at one end and secured. A fluid, preferably air, at about 3 psi is passed into the tube causing the tube to elongate and the everted tube face to travel along the length of a borehole. An explosive cartridge mounted against the tube face is carried to a desired location in the borehole after which the tube is partly deflated and withdrawn from the borehole.

3 Claims, 3 Drawing Figures

CHARGING LARGE DIAMETER VERTICAL BOREHOLES

The present invention relates to a method of charging boreholes with packages of explosives or tamping material. In particular, the invention is concerned with the loading of boreholes with packaged material when the boreholes are of relatively large diameter and are drilled vertically into the ceiling of an underground chamber.

Modern mining procedures now permit the excavation of large underground chambers in stable ore bodies. These procedures make use of relatively large diameter boreholes, up to 15 cm. in diameter or larger, and frequently these boreholes are drilled upward vertically into the ceiling of the chamber to depths (lengths) of 10 meters or longer. The placing of cylindrical packaged explosive charges into these vertical boreholes has been accomplished only with difficulty since a typical 15 cm. diameter explosive package may weigh up to 36 kilograms or more. In the procedure normally employed, a cylindrical explosive package is fitted into the mouth of the vertical borehole and manually pushed upward into the borehole using a wooden push rod. A locking device adapted to grip the borehole wall is located below the explosive package to retain the package in the borehole. A subsequent explosive package or packages plus packages of tamping material are similarly loaded into the borehole. The operation is labour intensive, time consuming, physically demanding, unsafe and expensive.

It has now been found that large diameter cylindrical explosive packages and tamping packages may be simply and conveniently elevated and placed into vertical boreholes (upholes) employing as the pushing or carrying means a longitudinally inflating, resilient, fluid impervious tube. By securely everting the end of a resilient tube close to the mouth or opening of a borehole and applying fluid pressure within the everted tube, the tube is caused to inflate longitudinally and migrate along the borehole pushing or carrying before it any appropriately sized cylindrical package or cartridge. When the cartridge has reached the desired location in the borehole, the tube is retracted to the mouth of the borehole leaving the cartridge suspended in the borehole. The method of the invention thus comprises the steps of inserting a material-containing cylindrical cartridge into the opening of a borehole, the cartridge being of a size to permit free passage through the borehole, pushing the cartridge along the borehole to a desired location by means of an everted, longitudinally, inflating resilient tube and, thereafter, withdrawing the resilient tube. A low air pressure is maintained in the system during withdrawal to prevent undue wrinkling or creasing of the tubing.

Various known means may be employed to retain the cylindrical cartridge in the borehole after withdrawal of the resilient push tube and include, for example, an oversized, resilient or hinged disk or spider adjacent the package base which disk or spider grips the internal borehole wall and, thus, anchors the package in the borehole. Such a gripping device is disclosed in British Pat. No. 800,676.

The novel method of borehole loading of the invention will be better understood with reference to the embodiment illustrated in the drawing wherein.

Figure 1:
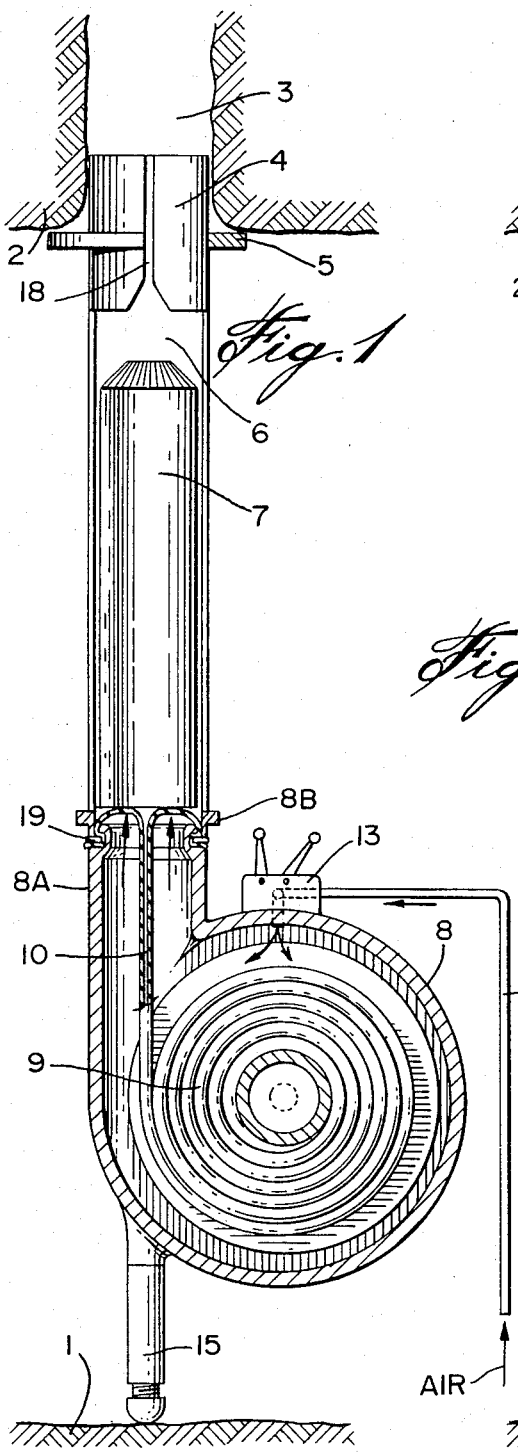
FIG. 1 is an elevational view, partly in cross-section, of an explosive cartridge mounted in a delivery apparatus prior to loading into a vertical borehole.
Figure 2:
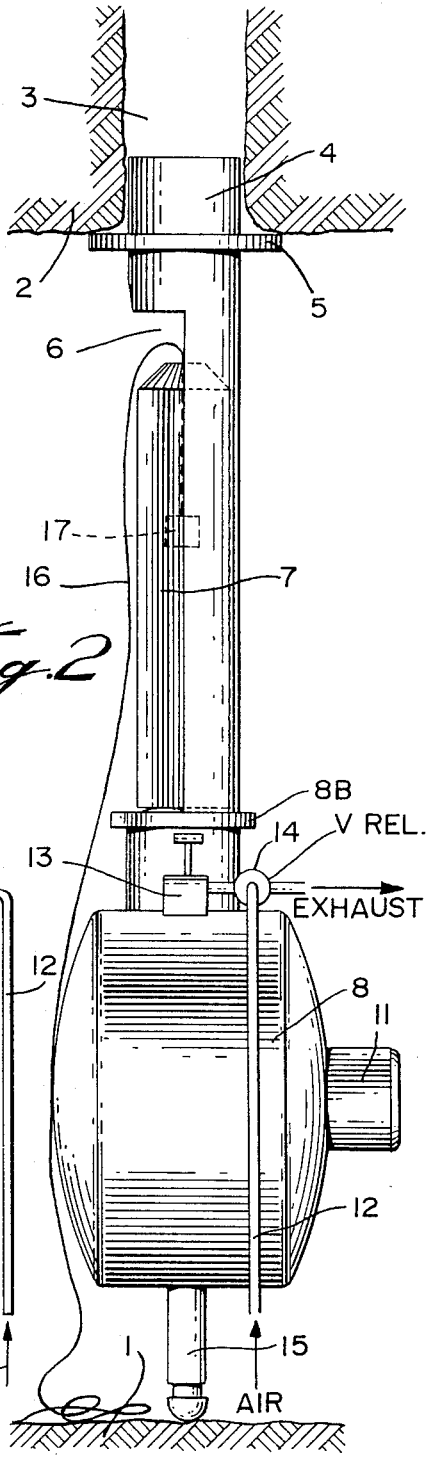
FIG. 2 shows a side view of the apparatus of FIG. 1.
Figure 3:
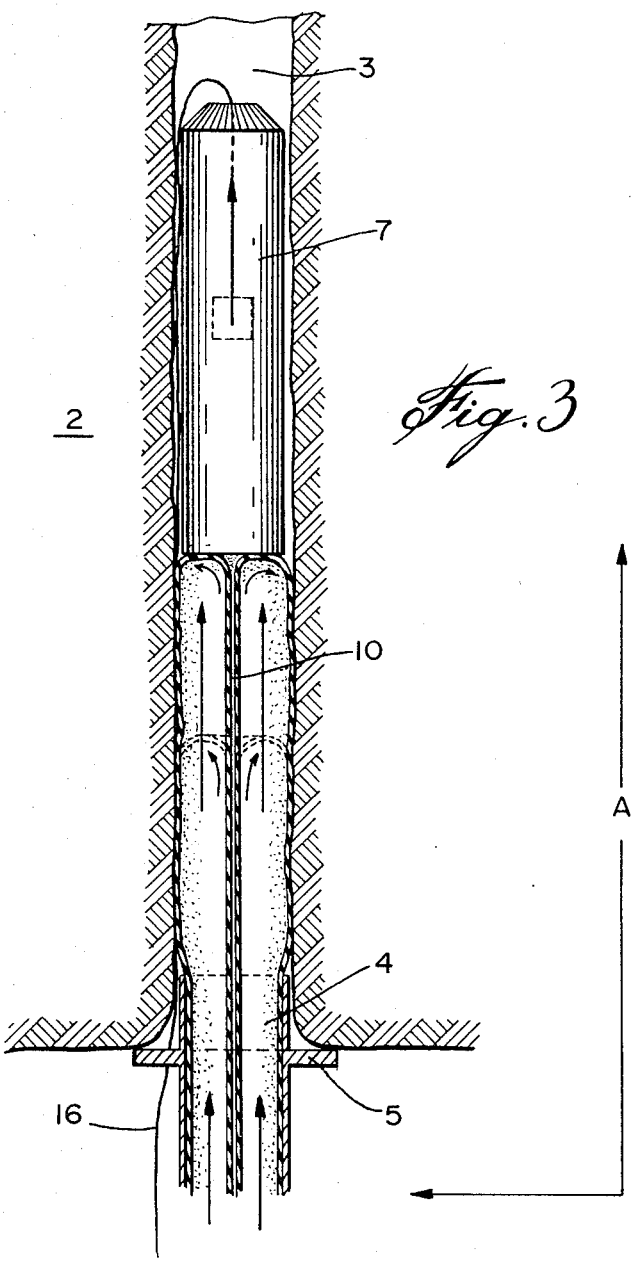
FIG. 3 shows the area A of FIG. 2 with an explosive cartridge being carried along the borehole.

With reference to the Figures of the drawing where like parts are designated by like numbers, there is shown a floor or platform base 1 and a ceiling 2 of, for example, an underground ore chamber. Located in ceiling 2 is an upward extending vertical borehole 3 of a diameter of, for example, 16.5 cm. Inserted into the mouth of borehole 3 is the end of loading pipe 4 having a diameter less than that of borehole 3. A restraining collar 5 restricts the entry of pipe 4 too deeply into borehole 3. Loading pipe 4 comprises a metal or plastic tube having a semicircular cut-out section or area 6 along its length of a dimension adequate to receive a large diameter, for example, 15 cm. diameter, cylindrical explosive cartridge 7. Loading pipe 4 is connected or coupled at junction 8B to cylindrical guide section 8A of air-tight housing unit 8. Housing unit 8, shown in cross-section, comprises a hollow structure within which is mounted a reel or roll 9 of elongated, fluid-impervious, flexible tubing material 10 having an inflated diameter slightly less than borehole 3. An air- or hydraulic-operated motor 11 which provides powered rotation to reel 9 is mounted upon housing 8. Compressed air from a source (not shown) enters housing 8 through conduit 12 and valve controls 13. Air is exhausted from housing 8 via a pressure relief valve 14 which maintains an appropriate back pressure (approx. 2 psi). The assembly of pipe 4 and housing 8 is mounted securely between ceiling 2 and floor or platform 1 by means of adjustable leg 15. In FIG. 2, a fuse 16 and associated detonator or primer 17 is shown connected to cartridge 7. A slotted opening 18 is provided in pipe 4 to permit the unobstructed passage through pipe 4 of fuse 16 as cartridge 7 is pushed upwardly through pipe 4 into borehole 3. Within housing 8, the leading circumferential edge of tubing 10 is everted and secured within and around the interior of guide section 8A by means of, for example, a securing ring 19. When pressurized air is admitted into housing 8 via conduit 12 and valve controls 13, the air presses against the everted inside face of the tubing 10 in the direction shown by the arrows, causing tubing 10, which is slightly less in diameter than borehole 3, to unwind from reel 9 and to inflate and unroll longitudinally within and along pipe 4 pushing cartridge 7 before it into borehole 3. When the cartridge has reached the closed end (the toe) of borehole 3, air flow to housing 8 is cut off and air motor 11 is operated to withdraw the everted tubing 10 against a back pressure maintained by pressure relief valve 14 from borehole 3. As it is withdrawn, tubing 10 is rewound upon reel 9.

In use in the field, an apparatus as shown in the Figures of the drawing is assembled at the blasting site with an appropriate pressurized air connection being made from a mine source (not shown) to air conduit 12. The leading end of pipe 4 is inserted into a borehole and the apparatus secured in alignment with the borehole by means of adjustable leg 15. A cylindrical explosive cartridge 7 having a diameter slightly less than that of borehole 3 is prepared by connecting thereto the appropriate initiation system, for example, fuse 16, cap and primer 17 or electric wires, electric cap and primer. The prepared cartridge is placed into pipe 4 through semicircular cut-out section 6 and air is gradually admitted into housing 8 through valve control 13 to inflate and unroll the everted tube 10 longitudinally and so deliver cartridge 7 to a desired position in the borehole. Cartridge 7 is adapted by means such as a spider gripper (not shown) to remain in the desired position in the borehole. The tubing 10 is, then, rewound upon reel 9 by means of air motor 11. Air relief valve 14 maintains an air pressure of about 2 psi to prevent wrinkling of tube 10 as it is rewound. A subsequent explosive cartridge or tamping cartridge can, then, be loaded into the borehole by repeating the procedure.

It will be appreciated that the length of tubing 10 required to push cartridge 7 to the toe of borehole 3 will be twice the length of the borehole since, when extended, tubing 10 is doubled back upon itself.

The material of construction of housing unit 8 and pipe 4 is, preferably, metal but pipe 4 may be usefully made from rigid plastic, such as, for example, ABS, PVC or the like. Fluid-impervious tubing 10 must combine the properties of flexibility and durability since it is exposed to sharp rock projections in the borehole. A material, such as, for example, rubber or plastic impregnated fabric having a wall thickness of from about 0.5 mm. to 2 mm. has been found suitable. When damaged or punctured, tubing 10 is easily replaced and additional lengths may be stored upon reel 9.

EXAMPLE

To test the utility of the method of the invention, a simulated vertical borehole was provided consisting of a 12.7 cm. internal diameter section of plastic pipe 3.66 meters in length. An apparatus as depicted in the Figures of the drawing was fitted with a length of 6 mil polyethylene tubing 8.9 cm. in diameter as the 'pusher' tube. A twenty pound dummy explosive cartridge weighing 9 kg. was lifted the full height of the simulated borehole upon the application of 3 psi air pressure.

As described, the present invention provides a convenient and safe means for elevating heavy explosive and tamping cartridges into upwardly extending boreholes. While particularly adapted for the charging of upholes, the method may also be employed in charging horizontal boreholes.

1. A method of charging an upwardly extending large diameter vertical borehole with a cylindrical explosive cartridge comprising the steps of providing a fluid-impervious flexible tubular element at the open end of said borehole, everting one end of said tubular element to form an inside-out face, mounting a base end of the said cylindrical cartridge against the said everted, tube face and applying pneumatic pressure within the said everted tube face to cause the tubular element to inflate longitudinally and to cause the everted tube face to travel along the said borehole pushing the said cylindrical cartridge before it to a selected location and thereafter withdrawing the inflated tube from the said borehole.

2. A method as claimed in claim 1 wherein the inflating pneumatic pressure within said tubular element is at least 3 psi.

3. A method as claimed in claim 1 wherein a positive pneumatic pressure is maintained within the tube during withdrawal from said borehole.

* * * * *